United States Patent [19]

Krulik

[11] 4,182,784

[45] Jan. 8, 1980

[54] METHOD FOR ELECTROLESS PLATING ON NONCONDUCTIVE SUBSTRATES USING PALLADIUM/TIN CATALYST IN AQUEOUS SOLUTION CONTAINING A HYDROXY SUBSTITUTED ORGANIC ACID

[75] Inventor: Gerald A. Krulik, Hoffman Estates, Ill.

[73] Assignee: McGean Chemical Company, Inc., Cleveland, Ohio

[21] Appl. No.: 861,385

[22] Filed: Dec. 16, 1977

[51] Int. Cl.[2] ..... C23C 3/02

[52] U.S. Cl. ..... 427/304; 106/1.11; 427/305; 427/306

[58] Field of Search ..... 427/304, 306; 106/1.11

[56] References Cited

U.S. PATENT DOCUMENTS

| | | | |
|---|---|---|---|
| 3,607,352 | 9/1971 | Fadgen et al. | 427/304 |
| 3,904,792 | 9/1975 | Gulla et al. | 427/304 |
| 4,001,470 | 1/1977 | Berge | 106/1.11 |
| 4,061,588 | 12/1977 | Gulla | 106/1.11 |

*Primary Examiner*—John D. Smith

*Attorney, Agent, or Firm*—Fay & Sharpe

[57] ABSTRACT

A tin-palladium catalyst useful for electroless deposition of metals, such as copper or nickel, onto a nonconductive substrate, said catalyst containing a much lower concentration of halide ions than similar compositions presently known, or being completely free of halide ions. The tin-palladium catalyst can be prepared from nonhalide salts using a hydroxy substituted organic acid to stabilize the system.

5 Claims, No Drawings

METHOD FOR ELECTROLESS PLATING ON NONCONDUCTIVE SUBSTRATES USING PALLADIUM/TIN CATALYST IN AQUEOUS SOLUTION CONTAINING A HYDROXY SUBSTITUTED ORGANIC ACID

CROSS-REFERENCE TO RELATED APPLICATION

Copending application Ser. No. 827,928, filed Aug. 26, 1977, describes a palladium-tin system in which certain hydroxy substituted organic acids may be employed to permit the working baths to be free from halide acids such as HCl. In this application, however, both the palladium and tin salts are chlorides, so that the resulting working baths contain a significant amount of chloride ion in solution.

BACKGROUND OF THE INVENTION

1. Field of the Invention

Tin-palladium catalysts and methods for electroless deposition generally classified in Class 427.

2. Description of the Prior Art

U.S. Pat. No. 3,607,352, issued to Fadgen et al on Sept. 21, 1971, describes the use of tartaric acid to improve the stability of a tin sensitizer. The theory is advanced that tartaric acid, which is one of the preferred hydroxy substituted acids of the present invention, inhibits tin oxychloride formation.

SUMMARY OF THE INVENTION

Insofar as is known to Applicant, stabilized tin-palladium catalysts are usually prepared by either using the chloride salt or bromide salt of palladium and/or tin; and the concentrate is generally dissolved in hydrochloric acid to make up the working bath. The working bath concentration usually ranges from 50 to 1000 mg. of equivalent palladium per liter of solution. In some cases, other salts of palladium and tin, such as stannous sulfate or palladium sulfate have been used to make up baths. However, these salts are dissolved in hydrochloric acid so that the bath contains considerable chloride ions furnished by the HCl. In other examples, the tin and palladium chlorides are dissolved in sulfuric acid. Thus, the total chloride concentrate is provided by one or more of the tin and palladium salts and HCl.

It has been discovered that the halides can be substantially, or even completely, replaced from both the catalyst concentrate and the working bath by using a hydroxy substituted organic acid in place of some or all of the halide ions. Active catalysts can be synthesized without formation of an inactive colloid, such as various tin hydroxides and oxychlorides, or precipitates of palladium.

It is a great advantage to eliminate (or substantially reduce) the halide content of tin-palladium solutions. All halide salts react with acid—e.g. $2NaCl+H_2SO_4 \rightarrow 2HCl+Na_2SO_4$—to form a relatively volatile halo acid. In addition to the safety aspects of these noxious fumes, the presence of such acids create severe problems in specialty applications, such as printed circuits where black copper oxide layers are used, or where stainless steel tank and rack pitting corrosion will occur.

DETAILED DESCRIPTION OF THE INVENTION

In order to best understand the principles of the present invention the following examples are set forth for the purpose of illustration only.

EXAMPLE I

A sample of 0.125 M. stannous tartrate and 0.125 M. tartaric acid were mixed with 200 mls. of deionized (DI) water. The pH was determined to be 1.6 and no chloride ions, or other halides, were present. To this solution was added 0.74 gms. $PdCl_2$ to yield a ratio of tin to palladium of 30:1. The resulting solution was heated to boiling for one hour. On a calculated basis, only 0.0083 moles of chloride ion, furnished by the $PdCl_2$ were present. The resulting reddish-brown liquid was stable and very catalytically active. A working bath was prepared by adding 20 ml. of the concentrate to 250 ml. of 1 M. tartaric acid.

In order to determine the catalytic activity of the solution described above, as well as all the other examples set forth herein, a standard electroless preplate process was utilized. In this case, test panels of an acrylonitrile, butadiene, styrene (ABS) graft polymer were sequenced through a conventional preplate system including: (1) etching in chromic acid/sulfuric acid bath; (2) neutralizing; (3) immersion in the palladium-tin bath for 5 minutes; (4) acceleration for 2½ minutes in an acid or base; and (5) then immersion in a standard room temperature electroless nickel bath containing nickel ions, a hypophosphite reducing agent and various stabilizing and buffering compounds. In the particular examples, the electroless nickel bath was a proprietary bath designated as N-35-manufactured by Borg-Warner Chemicals.

EXAMPLE II

A sample of 0.125 M. of stannous tartrate and 0.125 M. of tartaric acid were mixed with 200 mls. of water (DI). The pH was determined to be 1.6 and no chloride ions, or other halides, were present. To this solution was added 6 mls. of 10% $PdSO_4$ dissolved in sulfuric acid. The solution was heated to 60° C. for 30 minutes. As in Example I, a dark reddish-brown solution formed which upon dilution in Example I gave good to excellent plating on ABS test panels. It will be noted that the solution in this Example contained no chloride or halide ions, except, of course, for trace impurities.

EXAMPLE III

A solution was prepared by mixing 100 mls. water (DI), 20 gms. (0.1 M.) stannous sulfate and 9.8 gms. concentrated sulfuric acid. The solution was heated to boiling temperature to dissolve substantially all the stannous sulfate. To this hot solution was added 1 gm. (0.005 M.) $PdSO_4$ as a 10% solution in sulfuric acid. A brown precipitate was formed immediately and it was determined that this solution had no catalytic activity.

EXAMPLE IV

A solution was prepared by mixing 100 mls. water (DI), 20 gms. (0.1 M.) stannous sulfate, 9.8 gms. concentrated sulfuric acid and 15 gms. tartaric acid. The solution was heated to boiling temperature to dissolve substantially all the stannous sulfate. To this ho solution was added 1 gm. (0.005 M.) $PdSO_4$ as a 10% solution in sulfuric acid. The solution turned a reddish-brown color with virtually no sign of precipitate or colloidal material observed. A working bath was prepared by adding 20 mls. of the concentrate to 250 mls. of 1 M. tartaric acid. Catalytic activity was determined by plating on ABS panels and this solution gave good to excellent plating.

EXAMPLE V

A solution was prepared by mixing 100 mls. water (DI), 20 gms. (0.1 M.) stannous sulfate, 9.8 gms. concentrated sulfuric acid and 19.2 gms. citric acid. The solution was heated to boiling temperature to dissolve substantially all the stannous sulfate. To the hot solution was added 1 gm. (0.005 M.) $PdSO_4$ as a 10% solution in sulfuric acid. A reddish-brown color was noted with virtually no sign of precipitate or colloidal material. A working bath was prepared by adding 20 mls. of the concentrate to 250 mls. of 1 M. citric acid. Catalytic activity was determined by plating on ABS panels and this solution gave good to excellent plating.

EXAMPLE VI

A solution was prepared by mixing 100 mls. water (DI), 20 gms. (0.1 M.) stannous sulfate, 9.8 gms. concentrated sulfuric acid and 9.0 gms. lactic acid. The solution was heated to boiling temperature to dissolve substantially all the stannous sulfate. To this hot solution was added 1 gm. (0.005 M.) $PdSO_4$ as a 10% solution in sulfuric acid. As in Example IV to V, a reddish-brown color appeared with no observable precipitate or colloidal material. A working bath was prepared by adding 20 mls. of the concentrate to 250 mls. of 2 M. lactic acid. Catalytic activity was determined by plating on ABS panels and this solution also gave good to excellent plating.

Although some latitude is permitted, depending on immersion times and other operating conditions, the palladium concentration in the working bath is preferably from 0.05 to 5 gm./liter. The stannous to palladium ratio is preferably from 2:1 to 100:1 for optimum stability and catalytic activity.

While this invention has been described in connection with certain specific embodiments thereof, it is to be understood that this is by way of illustration and not by way of limitation; and the scope of the appended claims should be construed as broadly as the prior art will permit.

What is claimed is:

1. A method of rendering the surface of a non-conductive substrate catalytic to the electroless deposition of metal including the step of:

contacting the surface of said substrate with an aqueous solution obtained by (a) dissolving a stannous salt in an aqueous solution containing a hydroxy substituted organic acid and (b) reacting said stannous salt while in said solution with a palladium salt, with one or both of said palladium and said stannous salts being a salt other than a halide salt, with any halide ion present being derived from said palladium or said stannous salt.

2. A method as defined in claim 1 wherein said hydroxy substituted organic acid is selected from the group consisting of tartaric acid, citric acid, and lactic acid.

3. A method as defined in claim 2 wherein said organic acid is tartaric acid.

4. The method as defined in claim 2 wherein said organic acid is citric acid.

5. A method as defined in claim 2 wherein said organic acid is lactic acid.

* * * * *